United States Patent [19]

Ishikawa et al.

[11] Patent Number: 4,709,915

[45] Date of Patent: Dec. 1, 1987

[54] SORTING APPARATUS

[75] Inventors: Tadashi Ishikawa, Urawa; Kazuhiro Matsuo, Tokyo; Akimitsu Hoshi, Yokohama, all of Japan

[73] Assignee: Canon Kabushiki Kaisha, Tokyo, Japan

[21] Appl. No.: 17,032

[22] Filed: Feb. 18, 1987

Related U.S. Application Data

[63] Continuation of Ser. No. 663,678, Oct. 18, 1984, abandoned.

[30] Foreign Application Priority Data

Oct. 22, 1983 [JP] Japan ..... 58-197869

[51] Int. Cl.[4] ..... B65H 39/11

[52] U.S. Cl. ..... 271/288; 271/293; 271/296

[58] Field of Search ..... 271/292, 293, 294, 296, 271/297, 298, 287, 288, 289, 290

[56] References Cited

U.S. PATENT DOCUMENTS

| | | | |
|---|---|---|---|
| 4,087,087 | 5/1978 | Looney | 271/293 |
| 4,162,787 | 7/1979 | Shirahase et al. | 271/293 |
| 4,449,812 | 5/1984 | Furuichi et al. | 271/294 X |

FOREIGN PATENT DOCUMENTS

| | | | |
|---|---|---|---|
| 0061270 | 5/1981 | Japan | 271/292 |

*Primary Examiner*—Andres Kashnikow

*Attorney, Agent, or Firm*—Fitzpatrick, Cella, Harper & Scinto

[57] ABSTRACT

A sheet sorting apparatus of the type in which a stack of trays are integrally moved by a driving device so that individual trays are sequentially brought into association with a sheet discharger to receive the sheets. A sheet passage is branched out of the passage for receiving the sheet from the sheet discharger to the trays so that two passages are usable for supplying the sheet to the trays. One of the two sheet passages is selected in response to the selection of the mode from the sorting mode and non-sorting mode.

8 Claims, 8 Drawing Figures

SORTING APPARATUS

This application is a continuation of application Ser. No. 663,678, filed Oct. 18, 1984, now abandoned.

BACKGROUND OF THE INVENTION

The present invention relates to a sorting apparatus or a sorter for sorting sheet materials (hereinafter called "sheet") such as copy sheets, transfer sheets and recording sheets discharged from an image forming apparatus, e.g., a copying machine, a printing machine or other recording machines.

A sorter currently used includes ten-twenty or more sheet receiving plates (hereinafter called "trays"), each of which receives one-by-one the sheets sequentially discharged at regular intervals from a copying machine or the like. Such a sorter will be briefly described in conjunction with FIG. 1. A sheet P discharged by discharging rollers 1 and 1 of a copying machine C is advanced to an inlet of the sorter S disposed opposed to the copying machine, and guided to transporting rollers 3 and 3 by inlet guides 2 and 2. The transporting rollers 3 and 3 form a nip therebetween, to which a sheet receptor portion of one of the group of stacked trays 4 is opposed, so that the sheet is received on the tray. The transporting rollers 3 and 3 may be omitted by giving the transporting function also to the discharging rollers 1 and 1 of the copying machine C. Suppose that the sorter contains fifteen trays $4_1$, $4_2$, . . . , $4_{15}$, the trays except for the topmost and the bottommost trays are pivotably supported on tray supporting plates 5 which are located at the lateral sides thereof. The tray supporting plates 5, supporting the trays $4_1$, $4_2$, . . . , $4_{15}$, move upwardly intermittently so that the topmost tray $4_1$, the second tray $4_2$, . . . can sequentially receive the sheets advanced by the transporting rollers 3 and 3.

In this construction wherein the sheet receiving action starts from the topmost tray and takes place sequentially toward the bottom tray, the distance through which the tray group can move is as small as one-half of the height H of the sorter. Therefore, if the top face of the sorter is made at the same level as the top face of the copying machine C, the position of the inlet of the sorter is necessarily determined to be at about H/2 position. However, from the standpoint of facilitating the access of the operator to the sheets on the tray, the discharge tray of the copying machine is desirably to be located at an upper position. As the number of the trays of the sorter increases, the initial position of the sorter (e.g., non-sorting mode operation) is required to be positioned increasingly below the discharge tray of the copying machine, with the result that the operator has to stoop to access to the copy sheets.

SUMMARY OF THE INVENTION

Accordingly, it is a principal object of the present invention to provide a sorter by which the sheets can be easily accessed independently of the number of trays.

According to an embodiment of the present invention, as shown in FIG. 2, the above object is accomplished by the structure wherein the guides 2 and 2 for guiding to the tray the sheet P received from the discharging rollers 1 and 1 of the copying machine is divided into an upper transportation passage 24 and a lower transportation passage 25, and wherein a deflector 26 is pivotably mounted at the divided portion or the branch so as to select the passage from the two passages 24 and 25 in response to selection of the mode of operation, i.e., the sorting operation mode and the non-sorting operation mode. In this embodiment, the transportation passage for the sheets received from the sheet transporting means of an image forming apparatus is divided into upper and lower passages, wherein, in the non-sorting mode operation which is more frequently used, the upper passage is selected so as to feed the sheet to the uppermost tray. By doing so, the necessities can be avoided for lifting the trays after the completion of the sheet discharge and for waiting for the completion of the lifting operation. Additionally, the sheets can easily and quickly be taken from the tray. Further, the lower passage can be located at any position, so that the number of trays can be increased up to the point where the height of the stack of the trays is about one-half of the supporting post.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
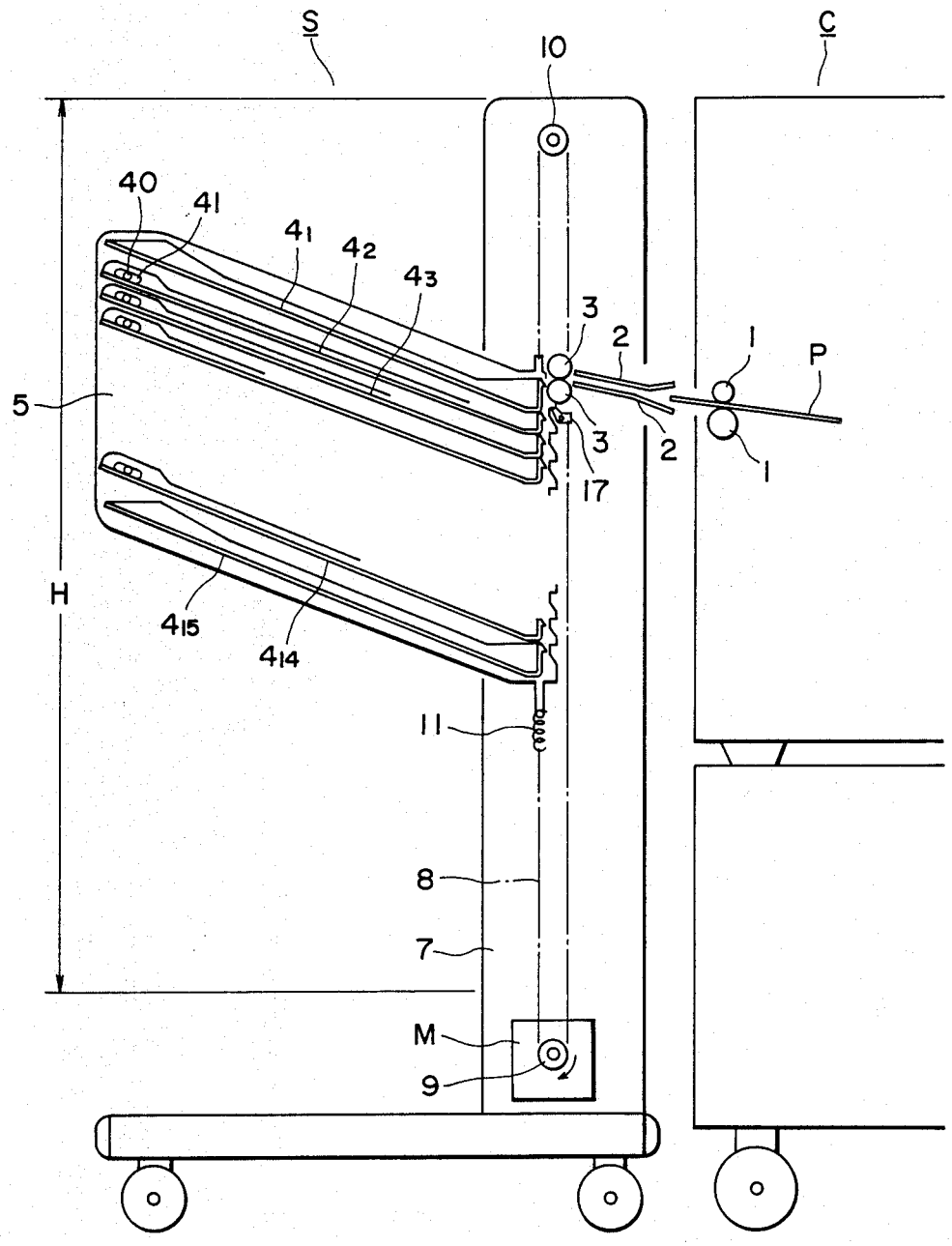
FIG. 1 PRIOR ART
FIG. 1 is a cross-sectional view of a conventional sorter.

The preferred embodiments of the present invention will be described in conjunction with the accompanying drawings. In the drawings, like reference numerals have been used throughout to designate the elements having the functions corresponding to those of the elements shown in FIG. 1 for the sake of simplicity.

Figure 2:
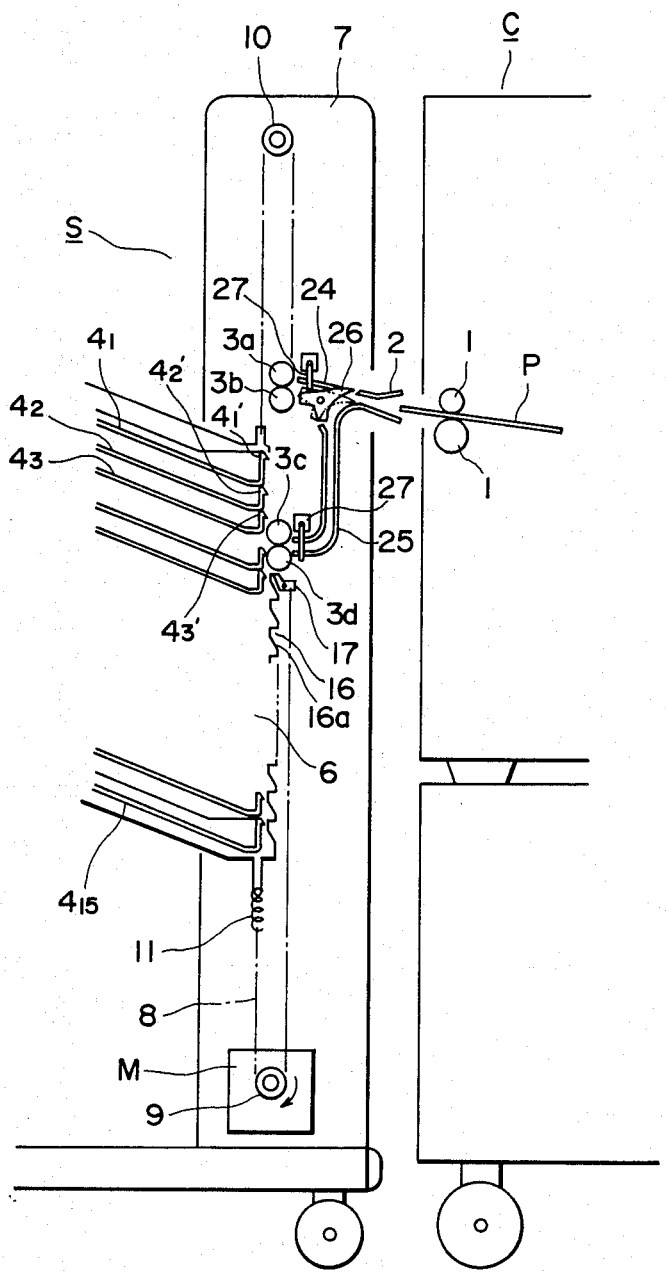
FIG. 2 is a cross-sectional view of a sorter according to an embodiment of the present invention.

FIG. 2 illustrates a sorter according to an embodiment of the present invention, wherein the sheet P discharged by the discharging rollers 1 and 1 of the copying machine C, is advanced to the inlet of the sorter S disposed opposed to the copying machine C, and guided by the inlet guides 2 and 2 to the transportation rollers *3a* and *3b* (or *3c* and *3d*). The transportation rollers *3a* and *3b* (or *3c* and *3d*) form a nip, to which a sheet receptor portion of one of the stack of trays is opposed, so that the corresponding tray receives the sheet. In this embodiment, the sorter contains fifteen trays $4_1$, $4_2$, . . . , $4_{15}$. The trays, except for the topmost and bottommost trays, are each supported pivotably on tray supporting plates 5 which are provided at the lateral sides of the sorter. As for the means for enlarging the sheet receptor portion of each of the trays, conventional means are usable, an example of which is shown in FIG. 3.

Figure 3:
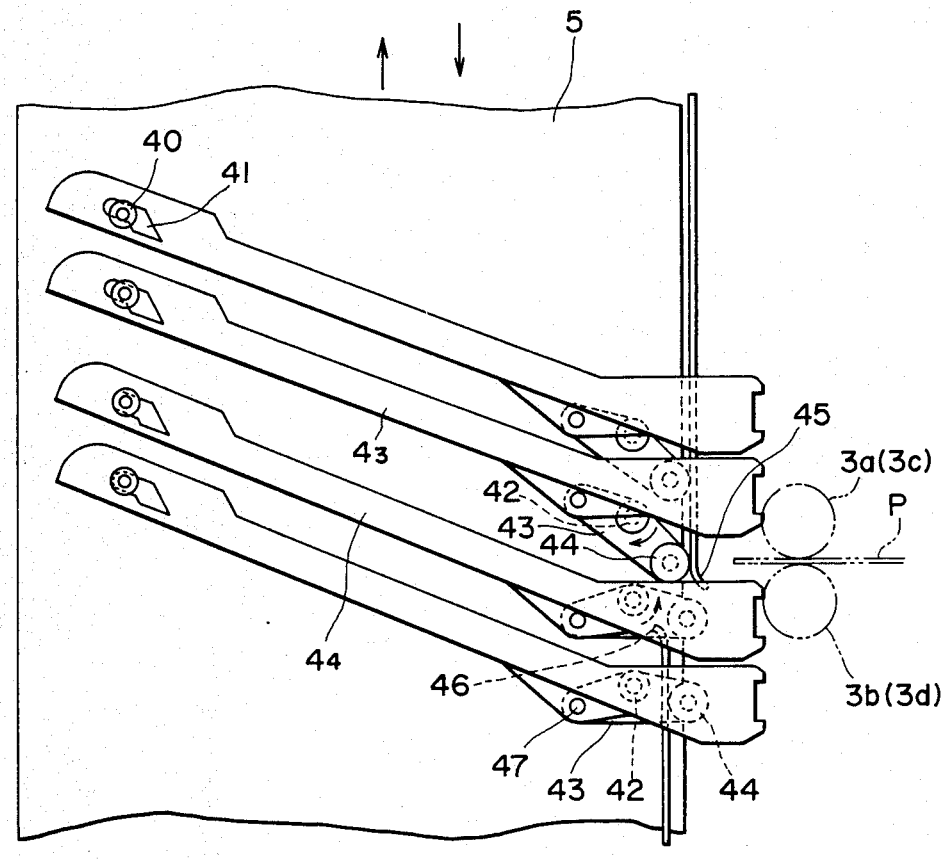
FIG. 3 is an enlarged side view of a part of the sorter shown in FIG. 2.

The trays are each provided adjacent its rear end with a hole 41 having the configuration as shown in FIG. 3, which is engaged and supported slidably on a pin 40 fixedly secured on the supporting plate 5. Adjacent to the inlet side of the tray, a lever 43 is pivotably supported on a pin 42 mounted on the supporting plate 5, for each of the trays. An end of the lever 43 is mounted to the tray by a pin 47, and the free end of the lever 43 is provided with a roll 44. A cam plate 45 is provided to enlarge the inlet to the tray in accordance with the lifting of the trays. Another cam plate 46 is provided to restore the position of the tray in accordance with the lowering of the trays. The two cam plates are disposed apart at the position of the rollers 3 and 3.

When the tray is moved upwardly by the supporting plate 5, as shown in FIG. 3, the roll 44 associated with the tray $4_3$ engages to the cam plate 45 to rotate the lever 43 about the pin 42 so as to raise the inlet side of the tray $4_3$ in addition to the upward movement of the supporting plate 5. Therefore, the inlet for the tray $4_4$ is broadened, so that the tray $4_4$ can receive the sheet.

When the tray moves down, the roll 44 of the tray $4_3$ which has been kept up by the cam plate $4_5$, moves away from the cam plate 45 and then engages to the other cam plate 46. This rotates the lever 43 in the counterclockwise direction to lower the inlet side of the tray $4_3$, thus restoring the tray.

A motor M (FIG. 2) is located adjacent the lower end of the post 7. The driving shaft of the motor M has a driving wheel 9 fixed thereto. Adjacent to the upper portion of the post 7, there is provided an idling wheel 10. Between those wheels 9 and 10, a chain or a wire 8 is entrained. The chain has an end fixed to an upper part of the supporting plate and the other end connected to the bottom of the supporting plate 5 by way of a coil spring 11 which is effective to absorb the shock given upon the movement of the trays. Therefore, the clockwise rotation of the motor M as seen in the Figure lifts the trays $4_1$, $4_2$, . . . , $4_{15}$ integrally with the supporting plates 5.

The supporting plates 5 move up and down along the post 7 at least through the distance corresponding to the distance from the topmost tray $4_1$ to the bottommost tray $4_{15}$.

The sheet P discharged out of the copying machine C is received and accommodated on the corresponding tray through the guides 2 and 2 of the sorter S and the transporting rollers 3*a* and 3*b* (or 3*c* and 3*d*). A sensor 27 is provided to sense the trailing edge of the sheet P. When it detects the trailing edge, a signal is produced, in response to which the supporting plates 5 which support the stack of trays are lifted so that the inlet of the next tray comes to the position where it is opposed to the transporting rollers 3*a* and 3*b* (or 3*c* and 3*d*), and the next tray waits for the next sheet P to come. Those operations are sequentially repeated until the bottommost tray $14_5$ receives the sheet P.

In FIG. 2, when non-sorting mode is selected by a selector switch not shown, the motor M does not operate, and the inlet port $4_1'$ of the topmost tray $4_1$ which has a larger accommodation than the other trays $4_2$–$4_{15}$ is placed to the position opposing the transporting rollers 3*a* and 3*b*, while the deflector 26 takes the position shown by the chain line to open the passage 24. Thus, the non-sorting operation mode is set. In this mode, all of the sheets P are accommodated on the topmost tray $4_1$.

When, on the other hand, the sorting mode is selected by an unshown selection switch, the motor M operates in response to the selection signal. By this, the stack of the trays 4 is moved down integrally with the supporting plates 5 so that the inlet portion $4_2'$ of the next (the second from the top) tray $4_2$ is moved to oppose the transporting rollers 3*c* and 3*d* and stops there, while the deflector 26 takes the position shown by the solid line to open the passage 25, thus setting the sorting mode.

In this sorting mode, when the sheet P transported by the transporting rollers 3*c* and 3*d* is received by the tray $4_2$, the sheet detection sensor 27 detects the reception. After the detection of the trailing edge of the sheet P, the motor M rotates in the clockwise direction as seen in the Figure, so that the inlet portion $4_3'$ of the next tray $4_3$ is opposed to the transporting rollers 3*c* and 3*d* by moving the stack of trays 4 upwardly.

Then, the above operation is repeated so that the required number of sorting actions is completed. After the completion, a resetting signal produced by an unshown mechanism actuates an electromagnetic mechanism 19 (FIG. 6) to release the locking pawl 17 from the notch 16. This restores the stack of trays 4 to the initial position, that is, the position where the inlet portion $4_1'$ of the topmost tray $4_1$ is opposed to the transporting roller 3*a* and 3*b*.

Figure 7:
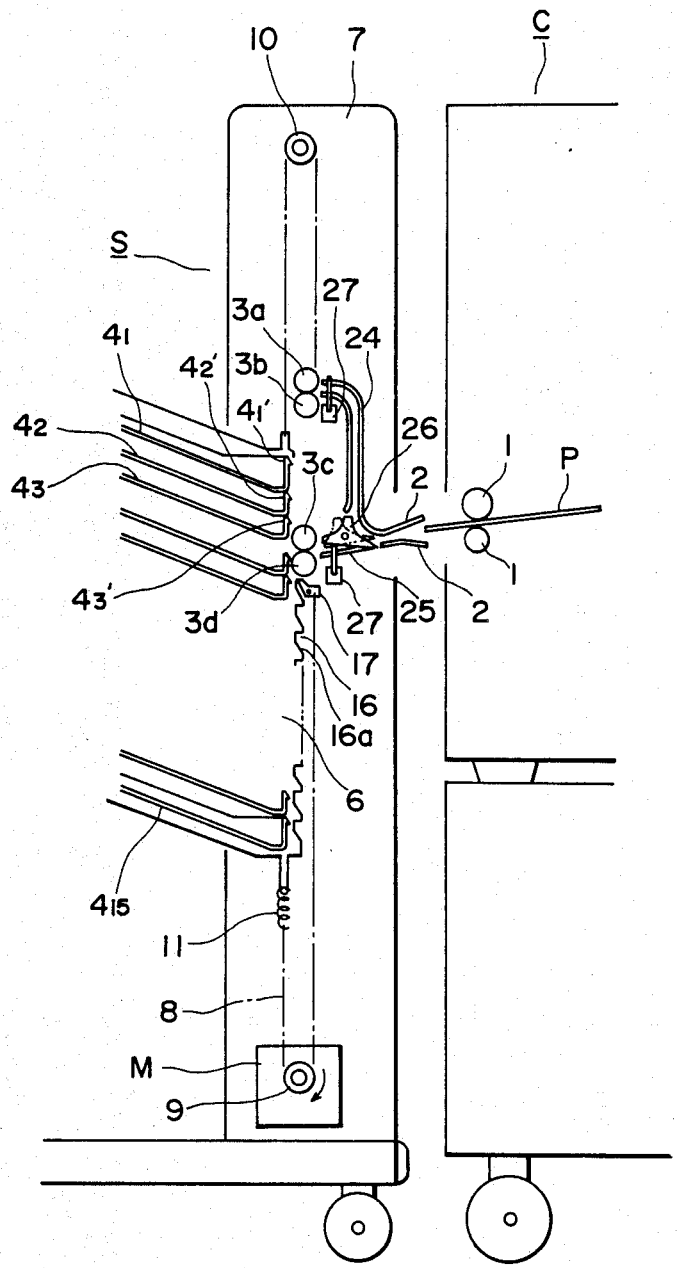
FIG. 7 is a cross-sectional view of a sorter according to another embodiment of the present invention.

FIG. 7 shows another embodiment of the present invention. Since this embodiment is similar to the foregoing embodiment, except for the portions which will be described, the detailed description of the similar portions is omitted for the sake of simplicity by assigning the same reference numerals to the elements having the corresponding functions. The sheet P discharged by the discharging roller 1 and 1 of the copying machine is advanced by the transporting guides 2 and 2 of the sorter S. When the deflector 26 takes the position shown by a solid line, the sheet P is advanced along the passage 24 and accommodated on the topmost tray $4_1$. This is the non-sorting mode. When the selecting switch is actuated to place the deflector 26 into the position shown by the chain line, the sheets P are accommodated on each of the trays. This is the sorting mode.

Figure 4:
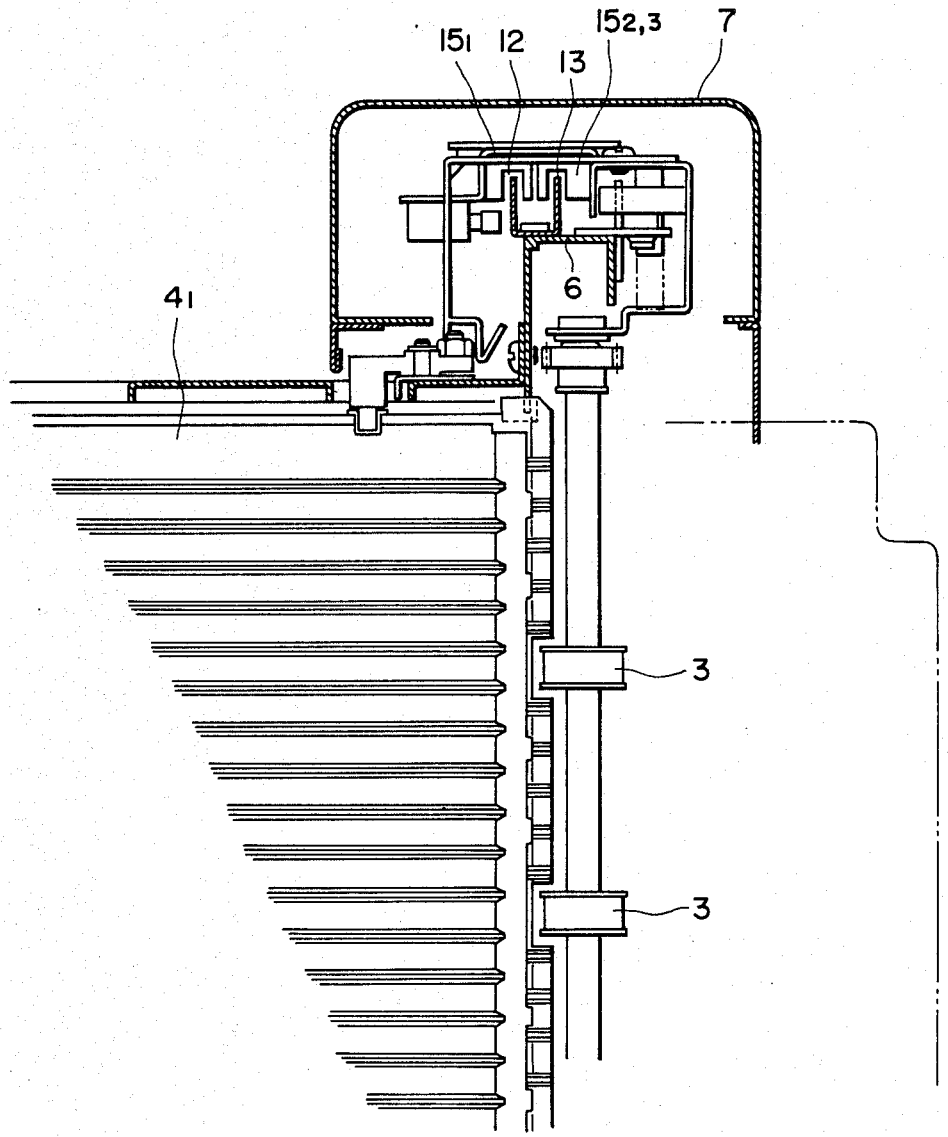
FIG. 4 is an enlarged plan view, partly in cross-section, of a part of the stack of the trays.
Figure 5:
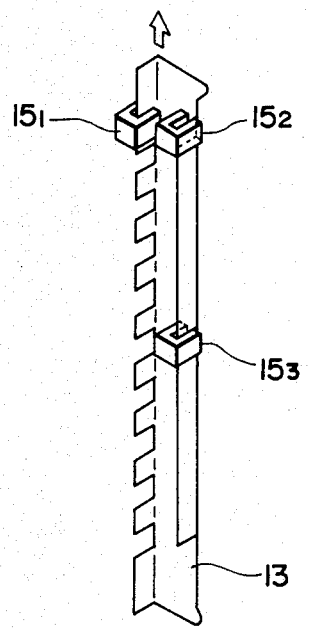
FIG. 5 is a perspective view of the sensor.

FIG. 4 is an enlarged plan view, partly in cross-section, of the sorter in the neighborhood of the post 7, and FIG. 5 illustrates the sensor. In the post 7, a notched plate 13 for positioning the trays is fixedly secured to a movable member 6 which is integral with the supporting plate 5 so that it can move along the groove 12. The notched plate 13 has notches at the positions corresponding to the trays and is provided with a light emitting element and a light receiving element. A tray position detecting sensor $15_1$, non-sorting position sensor $15_2$ and sorting position sensor $15_3$ are provided to detect the passage of the notched portion. In response to the detection signals, the motor M is stopped, while an electromagnetic brake (not shown) is also operated, thus correctly stopping the tray. When the non-sorting mode is selected, the motor M operates to move the movable member 6 until the non-sorting position sensor $15_2$ is actuated so that the inlet portion $4_1'$ of the topmost tray $4_1$ takes the position opposing to the transporting rollers 3*a* and 3*b*. In the sorting mode, the movable member 6 is similarly moved up until the sorting position sensor $15_3$ is actuated. The tray position detecting sensor $15_1$ is actuated for each of the trays, from the second tray to the bottommost tray, but it is not actuated for the first tray and when the sorter is being moved to the next tray.

Figure 8:
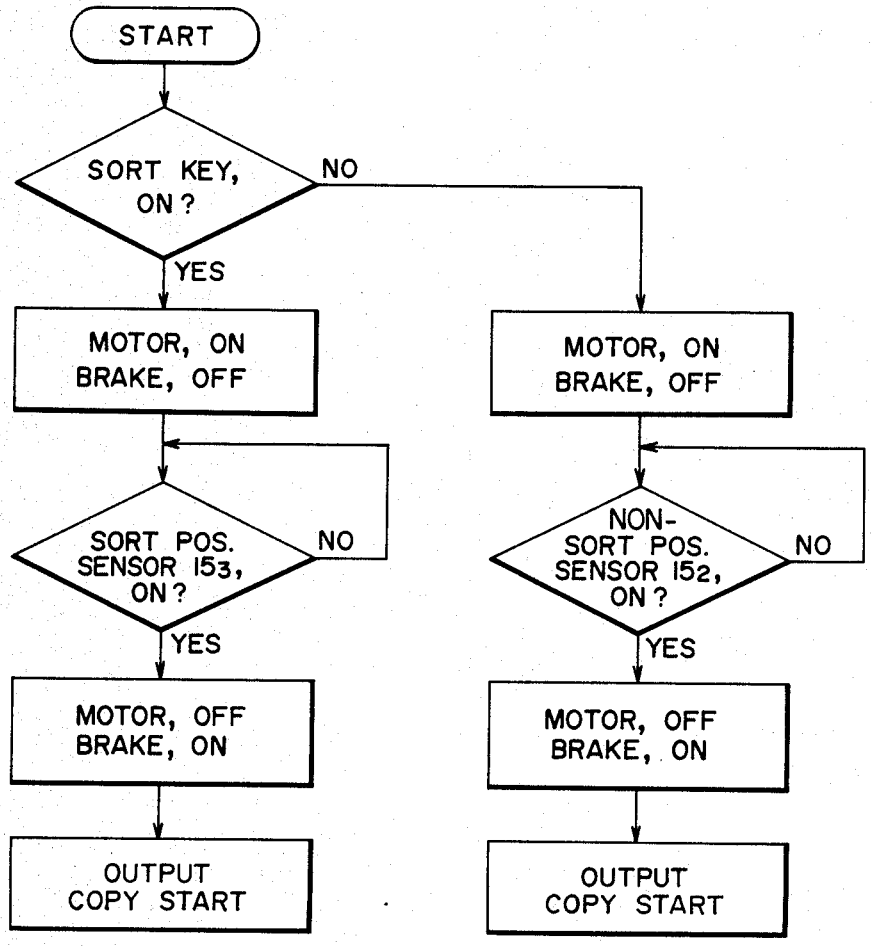
FIG. 8 is a flow chart of the operation of the device.

Next, FIG. 8 is a flow chart which shows the operation of the sorter. When the operator actuates the copy start key, the sorter detects whether the sorting mode is selected or whether the non-sorting mode is selected. If the sorting mode is selected, the electromagnetic brake is deactivated, and the motor M is actuated, so that the stack of trays is moved from the position which the stack takes then. When the sorting position sensor $15_3$ is actuated, that is, when the stack of trays is moved to the position where the sorting operation is to be effected, the motor M is stopped, and the electromagnetic brake is actuated. Thus, the stack of trays is correctly positioned for the sorting mode. Then, the softer transmits to the copying machine C a copy start signal. This makes the copying operation start. The stack of trays moves after each of the trays receives the sheet P. This is repeated to sequentially accommodate the sheets on the trays in order. If, on the other hand, the non-sorting mode is selected, the electromagnetic brake is the deactivated, and the motor M is operated, similarly, so that the stack of trays is moved from the position which is taken by itself then. When the non-sorting position sensor $15_2$ is actuated, that is, the stack of trays 4 is moved to the non-sorting position, the motor M is stopped, and the magnetic brake is actuated, thus correctly positioning the stack of trays at the non-sorting position. Then, the sorter S transmits to the copying machine C the copy start signal. In response to this, the copying machine C starts the copying operation. In this mode, the sheets P discharged out of the copying machine C is received on the topmost tray $4_1$.

Figure 6:
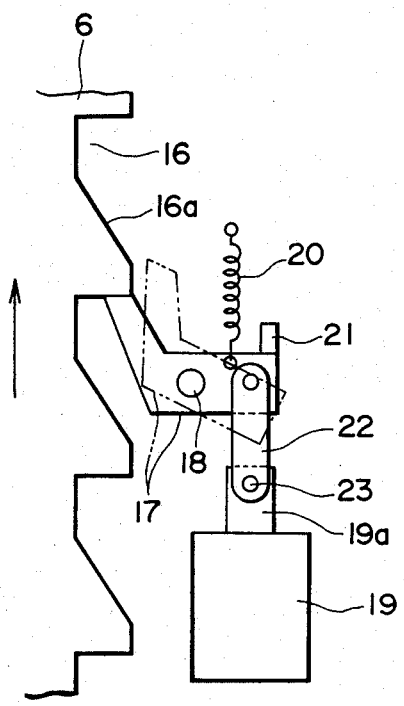
FIG. 6 is an enlarged side view of a stopping mechanism.

FIG. 6 is an enlarged view of a part of the movable member 6 to illustrate a tray stopping mechanism as shown in FIG. 6, the movable member 6 which is movable upwardly and downwardly has notches 16 at such a position as to align the inlet portions of the trays and the transporting rollers 3*a* and 3*b* (or 3*c* and 3*d*). To those notches 16, a pawl 17 is engageable, which is rotatably supported on a shaft 18. The pawl 17 is urged by the inclined part of the notch 16 when the trays move upwardly so that it is rotated to its retracted position, as shown by the chain line, to allow the upward movement of the trays by a string 20. The pawl 17 is connected through a link 22 by a pin 23 to a plunger 19*a* of a electromagnetic mechanism 19 for releasing the pawl.

A stopper 21 is provided, which is engaged by the pawl 17 against the spring force of the spring 20.

The stopping mechanism explained above for preventing the trays from falling, is effective to keep the tray by the engagement of the pawl 17 with the notch 16. Therefore, even if a power failure occurs, which would disable the electromagnetic brake for keeping the tray at an lifted position, the tray is prevented from falling. When the trays are to be restored to the initial bottommost positions, the electromagnetic mechanism 19 is energized to rotate the pawl 17 to the position shown by the chain line to release the engagement with the notch 16.

While the invention has been described with reference to the structures disclosed herein, it is not confined to the details set forth and this application is intended to cover such modifications or changed as may come within the purposes of the improvements or the scope of the following claims.

What is claimed is:

1. A sorting apparatus, comprising:

a plurality of trays arranged in substantially a vertical direction and movable in said direction;

a first sheet inlet for receiving a sheet material and directing it to one of said trays;

a second sheet inlet, disposed at a level lower than said first sheet inlet, for receiving the sheet material and directing it to said trays;

guiding means for guiding the sheet materials only to said first sheet inlet in a non-sorting mode operation, and for guiding the sheet material only to said second inlet in a sorting mode operation; and driving means for holding said one of said trays at a position for receiving the material from said first sheet inlet in the non-sorting mode operation and for setting, in the sorting mode operation, a topmost one of said trays for sorting, substantial alignment with said second sheet inlet and then driving said trays upward to sequentially dispose said plural trays a substantial alignment with said second sheet inlet.

2. An apparatus according to claim 1, wherein said one of said trays is a topmost of said trays.

3. An apparatus according to claim 2, further comprising detecting means for detecting that the topmost tray is at the position for receiving the sheet material from said first inlet and producing a non-sorting mode operation signal.

4. An apparatus according to claim 1, wherein said one of said trays has a sheet material accommodating capacity when receiving the sheet material which is larger than the capacity of the other trays.

5. An apparatus according to claim 1, further comprising detecting means for detecting that a first tray of said trays is at the position for receiving the sheet material from said second inlet and producing a sorting mode signal.

6. An apparatus according to claim 5, wherein said first tray is a second position tray as counted from the top.

7. An apparatus according to claim 1, wherein said second sheet inlet is at a level of about one half of a height of said apparatus.

8. A sorting apparatus according to claim 1, wherein said guiding means includes a first sheet passage for guiding the materials to said first sheet inlet in the non-sorting mode operation and a second sheet passage, which is longer than the first passage, for guiding the materials to said second inlet in the sorting mode operation.

* * * * *

UNITED STATES PATENT AND TRADEMARK OFFICE

CERTIFICATE OF CORRECTION

PATENT NO. : 4,709,915

DATED : December 1, 1987

INVENTOR(S) : TADASHI ISHIKAWA, ET AL.

It is certified that error appears in the above-identified patent and that said Letters Patent is hereby corrected as shown below:

Column 3, line 20, "45" should read --45--.

Column 5, line 9, "softer" should read --sorter--.

Column 6, line 20, "the material" should read --the sheet material--.

Signed and Sealed this

Tenth Day of May, 1988

*Attest:*

DONALD J. QUIGG

*Attesting Officer*

*Commissioner of Patents and Trademarks*